United States Patent [19]

Fono et al.

[11] 4,166,717

[45] Sep. 4, 1979

[54] PROCESS FOR DYEING CELLULOSIC TEXTILES WITH INDIGO

[75] Inventors: Andrew Fono, Montclair, N.J.; Ray F. Patton, Burlington, N.C.

[73] Assignee: Royce Chemical Company, East Rutherford, N.J.

[21] Appl. No.: 883,271

[22] Filed: Mar. 3, 1978

Related U.S. Application Data

[63] Continuation of Ser. No. 706,203, Jul. 19, 1976, abandoned.

[51] Int. Cl.[2] ..... C09B 7/00; C09B 7/02; C09B 9/04; D06P 1/22

[52] U.S. Cl. ..... 8/38; 8/35

[58] Field of Search ..... 8/35, 38

[56] References Cited

U.S. PATENT DOCUMENTS

| | | | |
|---|---|---|---|
| 1,535,151 | 4/1925 | Eustis | 8/38 |
| 2,233,101 | 2/1941 | Kern | 8/38 |
| 3,083,068 | 3/1963 | Weber et al. | 8/35 |
| 3,645,665 | 2/1972 | Etters | 8/79 |
| 3,804,944 | 4/1974 | Kise et al. | 423/515 |

FOREIGN PATENT DOCUMENTS

| | | | |
|---|---|---|---|
| 829177 | 2/1960 | United Kingdom | 8/35 |

OTHER PUBLICATIONS

Etters, J. N., Textile Chemist and Colorist, Mar. 1972, pp. 83–88.

*Primary Examiner*—Melvyn I. Marquis
*Assistant Examiner*—Maria S. Tungol
*Attorney, Agent, or Firm*—Brumbaugh, Graves, Donohue & Raymond

[57] ABSTRACT

The specification describes an improved process for dyeing cellulosic textiles with indigo which comprises reducing indigo dye to its soluble leuco form, incorporating an aldehyde addition product to the reduced indigo dye solution, immersing a cellulosic textile, and exposing the textile to air to oxidize the dye to its insoluble color. The specification describes also the reducing agent, the aldehyde addition product and the conditions required for optimum dyeing.

8 Claims, No Drawings

PROCESS FOR DYEING CELLULOSIC TEXTILES WITH INDIGO

This is a continuation, of application Ser. No. 706,203, filed July 19, 1976, now abandoned.

Indigo, probably the oldest known coloring agent, has been used to dye cellulosic textiles, such as cotton, for centuries. The dark blue dye is still employed extensively today for dyeing cotton yarn in the manufacture of denims and "blue jeans". In view of the widespread use of indigo for dyeing textiles, attempts are constantly being made to improve existing dyeing processes to conserve dye and time while optimizing color yield and shade control.

Indigo, a vat dye, is practically insoluble in water, alcohol, ether and dilute acids. In order to apply indigo to a textile, therefore, it has been necessary to reduce the dye to its soluble leuco form using a suitable reducing agent with an alkaline material, e.g. sodium hydroxide. [*American Cotton Handbook*, 2nd ed., Textile Book Publishers, Inc. New York, New York (1949)]. After a given textile has been impregnated with the reduced dye, the textile has been exposed to air or oxygen in order to oxidize the dye back to its insoluble color. The process usually has required alternately immersing the textile in a vat containing the reduced dye and exposing the immersed textile to air or oxygen. These two steps have been repeated to obtain the desired shade. This frequently has required five to seven immersions.

In the past, sodium dithionite has been employed as a reducing agent for dyeing cellulosic textiles with vat and sulfur dyes (U.S. Pat. No. 3,798,172, which is incorportated herein by reference). As noted above, the dye must be in its soluble leuco state in order to penetrate cellulosic textiles. Sodium dithionite, however, decomposes rapidly in the presence or absence of air. Therefore, large excesses of this compound have been required to reduce all of the dye and to maintain the dye in its soluble leuco form in the dyeing solution for reasonable periods of time.

Numerous attempts have been made to stabilize sodium dithionite against decomposition and thereby optimize the amount of reducing agent required for dyeing cellulosic textiles [U.S. Pat. Nos. 3,645,665, 3,798,172 and 3,804,944; Etters, *Textile Chemist and Colorist*, 4, 83 (1972); Etters, *Textile Chemist and Colorist*, 7, 209 (1975); and Shah, *Textile Chemist and Colorist*, 4, 268 (1972)].

Sodium formaldehyde sulfoxylate, known also as sodium hydroxymethanesulfinate, and other sulfinic acid derivatives have been used for vat and sulfur dyes (U.S. Pat. No. 3,265,459 and British Pat. Nos. 873,940 and 829,177, which are incorporated herein by reference). In many commercial applications, however, these compounds, alone, react too slowly as reducing agents for vat and sulfur dyes.

Generally, the complex chemical reactions taking place in the indigo dye solution have been sensitive to slight changes in pH, temperature and amount of the individual substances. For example, if the pH is too low, the dye may precipitate in its acid form; if the dithionite concentration is too low, the dye may oxidize prematurely resulting in a loss of valuable dye. Despite the fact that indigo dyeing has been known for many years, the quest continues for the optimum dyeing conditions which will insure precise shade control with a minimal loss of dye and reducing agent.

It has now been discovered that color yield in an indigo dyeing process may be increased. According to the present invention, an aqueous indigo dye solution is prepared by reducing indigo with sodium dithionite in the presence of sodium hydroxide to form a dye solution with substantially all of the dye in its soluble leuco form, incorporating an aldehyde addition product to stabilize the indigo dye solution with or without additional sodium dithionite, immersing a cellulosic textile in the stabilized indigo dye solution, and exposing the immersed textile to air or oxygen to oxidize the indigo dye back to its insoluble color. The immersion and exposure of the textile may be repeated until the desired color is obtained, preferably five to seven immersions and exposures being required. By carefully controlling the critical amounts of dye, sodium dithionite reducing agent, sodium hydroxide and aldehyde addition product, color yield is improved significantly.

As stated throughout the specification, the present invention is concerned with dyeing textiles with indigo dyes only. As defined herein, indigo dyes include, without limitation, any dye derived from indigo, $C_{16}H_{10}N_2O_2$, which is considered to have the structural formula:

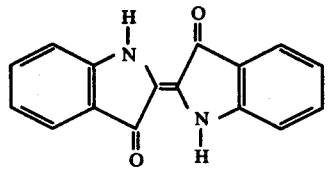

According to the process of the invention, the indigo is reduced to its soluble leuco form with sodium dithionite. This reducing agent, which has the formula $Na_2S_2O_4$, is known also as sodium hydrosulfite and hydro.

In order to provide an aqueous solution with the indigo dye in its leuco form, sodium hydroxide is used. Since hydroxide ions are constantly reacting with the dye and the reducing agent, it may be necessary to add hydroxide ions during the process. The amount of sodium hydroxide in the indigo dye solution must not exceed about 3% by weight of the solution throughout.

In the invention, the aldehyde addition product, is added to the solution only after the indigo dye has been reduced entirely to its soluble leuco form. The aldehyde addition product may be added alone or together with additional sodium dithionite in order to maintain the critical molar ratios of materials as described hereinbelow. Suitable aldehydes, without limitation, are formaldehyde, acetaldehyde and furfural. Suitable adducts for the addition product, without limitation, are bisulfite or sulfoxylate. The stabilizer, for example, may be formaldehyde-bisulfite, acetaldehyde-bisulfite, furfural-bisulfite, formaldehyde-sulfoxylate, acetaldehyde-sulfoxylate and furfural-sulfoxylate, and mixtures thereof. The preferred compounds are the aldehyde-bisulfite addition products described in U.S. Pat. Nos. 3,645,655 and 3,798,172, which are hereby incorporated by reference.

The amounts of indigo, sodium hydroxide, sodium dithionite and aldehyde addition product in the dye solution are critical features of the present invention. In this regard, the molar ratio of aldehyde addition product to indigo should be greater than about 0.7, preferably about 0.7 to 1.7. The molar ratio of dithionite reducing agent to aldehyde addition product should be greater than about 1.1, preferably about 1.1 to 2.25. Furthermore, the amount of sodium hydroxide in the dye solution must not be greater than about 3% by weight.

Depending on the dyeing process used, other cptional ingredients may be added to the reducing agent composition to facilitate dyeing. For example, a surface active agent or detergent, such as Nekal NF, may be added to reduce surface tension and to wet the cellulosic textile. A chelating agent, such as ethylenediaminetetraacetic acid and salts thereof, may be added to complex iron and other heavy ions. Also, sodium chloride may be added to increase the affinity of the dyestuff for the cellulosic textile. Finally, a thickening agent, such as the polymeric material described in Etters, *Textile Chemist and Colorist*, 7, 209 (1975), which is incorporated herein by reference, may be added where it is advantageous to increase the viscosity of the reducing agent composition solution.

The dye solution containing the reduced indigo dye, sodium hydroxide, sodium dithionite and aldehyde addition product is then applied to a cellulosic textile. The term "cellulosic textile" as defined herein includes without limitation all-cotton fabrics and yarns, or fabrics and yarns containing cotton blended with synthetic or other fibers such as rayon, polyester, and polyacrylonitrile fibers. The term covers any yarn, rawstock or such fibers, or any such fabrics whether woven or knitted. These textiles are also well known in the art (U.S. Pat. No. 3,798,172, which is incorporated herein by reference).

A wide variety of known indigo dyeing processes can be employed to apply the dye to the textile. These include, without limitation, both batch and continuous dyeing processes, such as the pad-steam, pad-batch, package, beam, long-bath and jig processes.

Any suitable temperature which effects dyeing may be used. Generally, temperatures will range from about 25° C., to 110° C., preferably about 25° C. to 35° C. Process times will vary according to the textile being dyed and the shade desired. Immersion times frequently range from about seven to thirty seconds. The exposure times range from about fifteen seconds to two minutes.

Using the process of the invention, the end product is an indigo dyed cellulosic textile having improved wet fastness properties, such as wash fastness and wet crock fastness. Depending on the process used, the relative color yield, which is determined visually by experts in the field, may increase in an amount up to 50% by employing the reducing agent composition of the invention; thus a potential indigo dye saving in an amount up to 50% may be realized. Furthermore, shade control becomes easier, and dyeing time is reduced.

The following examples are submitted to illustrate but not to limit the invention. Unless otherwise indicated, all parts and percentages in the specification and claims are based on weight.

EXAMPLE I

An indigo dye stock solution was prepared as follows: 20 grams of indigo was reduced to its leuco form with 20 grams of sodium dithionite and 20 grams of sodium hydroxide in water. The solution was diluted to 500 ml with water, and aged for 12 hours.

Sample 1 (control). Sixty milliliters of the above indigo dye stock solution, an additional 2.5 grams of sodium dithionite, and 2.5 grams of sodium hydroxide were added to a vat and diluted further to 500 milliliters with water. No additive was added to this final solution. The amount of sodium hydroxide was 0.98% by weight of the final solution.

A ten gram cotton skein was dyed by immersing it in the dye final solution for fourteen seconds at a temperature of 25° C. The immersed cotton skein was then passed through a wringer and exposed to air for sixty seconds to oxidize the indigo dye. This sequence of immersion and exposure was repeated four times. The sample was soaked subsequently in cold water for ten minutes, washed with soap and hot water and dried. The color of the sample therefrom was determined visually and assigned a value of 100.

Sample 2. The procedure for Sample 1 was repeated except that five milliliters of a solution of acetaldehyde-bisulfite addition product were added to the indigo dye final solution. The addition product added contained about 0.5 grams of acetaldehyde for a molar ratio of addition product to indigo of about 1.1. The molar ratio of sodium dithionite to aldehyde addition product was 2.1. The cotton skein was then dyed according to the above procedure.

Sample 3. The procedure for Sample 1 was repeated except that five milliliters of a solution of formaldehyde-bisulfite addition product were added to the vat. The addition product contained 0.33 formaldehyde for a molar ratio of addition product to indigo of about 1.1. The molar ratio of sodium dithionite to aldehyde addition product was 2.1. The cotton skein was then dyed according to the above procedure.

Sample 4. Forty-two milliliters of the above indigo dye stock solution, an additional 2.5 grams of sodium dithionite, and 2.5 grams of sodium hydroxide were added to a vat and diluted to 500 milliliters with water. After all of the indigo dye was in its soluble leuco form, five milliliters of the acetaldehyde-bisulfite addition of Sample 2 were added to the vat giving a molar ratio of addition product to indigo of 1.6. The molar ratio of sodium dithionite to addition product was 1.8. The cotton skein was then dyed according to the above procedure described in Sample 1.

Sample 5. The procedure of Sample 4 was repeated except that five milliliters of the formaldehyde-bisulfite addition product of Sample 3 were added to the vat. In the vat, the molar ratio of addition product to indigo was 1.6, and the molar ratio of sodium dithionite to addition product was 1.8.

Sample 6. The procedure of Sample 1 was repeated except that five milliliters of pure acetaldehyde were added to the vat.

Sample 7. The procedure of Sample 1 was repeated except that five milliliters of pure formaldehyde were added to the vat.

Table I below lists the amounts of reduced indigo dye solution, the additive, and the color strength for each of the above samples.

Table I

| Sample | Reduced Indigo Dye Solution | Additive | Color Strength |
|---|---|---|---|
| 1 (control) | 60 ml | None | 100 |
| 2 (invention) | 60 ml | acetaldehyde-bisulfite | 130 |
| 3 (invention) | 60 ml | formaldehyde-bisulfite | 130 |
| 4 (invention) | 42 ml | acetaldehyde-bisulfite | 100 |
| 5 (invention) | 42 ml | formaldehyde-bisulfite | 100 |
| 6 (comparison) | 60 ml | acetaldehyde | 100 |

Table I-continued

| Sample | Reduced Indigo Dye Solution | Additive | Color Strength |
|---|---|---|---|
| 7 (comparison) | 60 ml | formaldehyde | 100 |

The table demonstrates the improved results when cotton is dyed according to the process of the invention. For Samples 2 and 3, the color strength increased 30% relative to the control when the acetaldehyde-bisulfite and formaldehyde-bisulfite addition products, respectively, were added to the reduced indigo dye solution. Samples 4 and 5 illustrate that the relative color strength obtained with the addition products was the same as that of the control even when the amount of reduced indigo dye solution was decreased from sixty to forty-two milliliters. Finally, Samples 6 and 7 show that the addition of an uncomplexed aldehyde alone had no effect on the color strength of the dyed textile relative to the control.

EXAMPLE II

The amount of sodium hydroxide in Example I was raised to determine the effect of excess hydroxide. The amount of sodium hydroxide was 4% by weight of the final solution. Using the procedure described in Example I, the color strength decreased 20% for Samples 2 and 3. This illustrates the criticality of the amount of sodium hydroxide in the present process.

EXAMPLE III

Sixty milliliters of the indigo dye stock solution prepared in Example I, 0.5 grams of sodium dithionite and 2.5 grams of sodium hydroxide were added to a vat and diluted to 500 milliliters with water to form a final solution with all of the dye in its soluble leuco form. Sodium formaldehyde-sulfoxylate (1.7 grams) was added to the indigo dye final solution. For this Example, the amount of sodium hydroxide was 1% by weight of the final solution. The molar ratio of addition product to indigo was 1.1, and the molar ratio of sodium dithionite to addition product was 1.4.

The procedure according to Sample 1 of Example 1 was repeated. The dyed cotton skein was compared with a control cotton skein sample which was dyed without the presence of any aldehyde addition product. The skein dyed with the sodium formaldehyde sulfoxylate additive had a color strength that was 30% greater than the control.

EXAMPLE IV

The procedure of Example I, to prepare a reduced indigo dye stock solution was repeated in the presence of twenty milliliters of acetaldehyde-bisulfite addition product. The stock solution was aged 12 hours.

With the above stock solution, the procedure for Sample 2, Example I was repeated, but only 2.6 milliliters of the acetaldehyde-bisulfite solution was used. The composition of the resulting vat was the same as in Example I, Sample 2, just the order of addition was different.

The color strength was significantly weaker than of Sample 2, Example I. It was about 80 using the relative scale of Table I.

EXAMPLE V

By repeating the procedure of Example I, it is considered that cellulosic textiles may be dyed with indigo by adding to the final solution the following aldehyde addition products:

furfural-bisulfite
acetaldehyde-sulfoxylate
furfural-sulfoxylate

Having set forth the general nature and specific embodiments of the present invention, the true scope of the invention is now particularly pointed out in the appended claims.

We claim:

1. A process for dyeing cellulosic textile with indigo dye which comprises: reducing indigo with sodium dithionite in the presence of sodium hydroxide to form a dye solution with all of the dye in its soluble lueco form; aging the dye solution for about 12 hours adding additional sodium dithionite and sodium hydroxide to the aged dye solution; incorporating an aldehyde bisulfite or an aldehyde sulfoxylate addition product to stabilize the aged dye solution with additional sodium dithionite and sodium hydroxide therein; immersing a cellulosic textile in the stabilized dye solution maintained in the range of about 25° C. to 35° C.; and exposing the immersed cellulosic textile to air or oxygen to oxidize the indigo dye back to its insoluble color; said aldehyde addition product to indigo dye having a molar ratio greater than about 0.7; said sodium dithionite to aldehyde addition product having a molar ratio greater than about 1.1; said sodium hydroxide not exceeding about 3% by weight of the dye solution.

2. The process according to claim 1 wherein the aldehyde addition product is selected from the group consisting of formaldehyde-bisulfite, acetaldehyde-bisulfite, furfural-bisulfite, formaldehyde-sulfoxylate, acetaldehyde-sulfoxylate, furfural-sulfoxylate and mixtures thereof.

3. The process according to claim 2 wherein the aldehyde addition product is formaldehyde-bisulfite.

4. The process according to claim 2 wherein the aldehyde addition product is acetaldehyde-bisulfite.

5. The process according to claim 2 wherein the aldehyde addition product is furfural-bisulfite.

6. The process according to claim 2 wherein the aldehyde addition product is formaldehyde-sulfoxylate.

7. The process according to claim 2 wherein the aldehyde addition product is acetaldehyde-sulfoxylate.

8. The process according to claim 2 wherein the aldehyde addition product is furfural-sulfoxylate.

* * * * *